United States Patent [19]

Yeh

[11] Patent Number: 4,729,168

[45] Date of Patent: Mar. 8, 1988

[54] TWO-EDGED MULTI-PURPOSE ARTISTIC TECHNICAL KNIFE

[76] Inventor: Jia-Yong Yeh, 82, Hsing Jen Road, Sec. 1, Neili Li, Chungli City, Taoyuan Hsien, Taiwan

[21] Appl. No.: 897,054

[22] Filed: Aug. 15, 1986

[51] Int. Cl.[4] ..... B26B 1/08; B26B 9/00

[52] U.S. Cl. ..... 30/162; 30/346.5; 30/346.61

[58] Field of Search ..... 30/346, 162, 163, 346, 30/346.5, 346.52, 349, 346.61

[56] References Cited

U.S. PATENT DOCUMENTS 1,581,694 4/1926 Smith ..... 30/346.61 X
1,584,826 6/1926 Strand ..... 30/346.61 X
1,734,554 11/1929 Behrman ..... 30/346.61 X
3,448,518 6/1969 Sklar ..... 30/162

*Primary Examiner*—Douglas D. Watts
*Attorney, Agent, or Firm*—Wegner & Bretschneider

[57] ABSTRACT

An artistic technical knife which has a double-edged blade having a sharpened point at its terminus and a number of frangible recesses extending at oblique angles from one edge of the blade to the opposite side of the blade to divide the blade into a number of triangles; a blade holder; and a push knob for extending and retracting the blade from the blade holder; wherein the outermost triangle on the blade can be severed and removed at the outermost cleavage recess to provide a new sharpened point at the terminus of the blade.

2 Claims, 4 Drawing Figures

TWO-EDGED MULTI-PURPOSE ARTISTIC TECHNICAL KNIFE

BACKGROUND OF THE INVENTION

This invention relates to an artistic technical knife, having an extendible and retractable blade that is suitable for cutting paper and other materials.

The prior art artistic technical knife, as shown in FIG. 1, comprises a sectional and frangible blade 1 inserted in a holder 2. The prior art blade is single-edged, that is, only one edge is sharpened. To extend or retract blade 1 from holder 2, a push knob 3 attached to blade 1 is moved to the left or right. To use the knife, the end of blade 1 is extended from holder 2. When the cutting edge of the blade becomes blunt, a section having the shape of a parallelogram at the end of the blade is broken along a frangible recess or weakened line 6 so that a new cutting edge becomes available. The prior art artistic technical knife wastes a significant portion of the blade. Since the blade is typically made of an expensive steel alloy, it is wasteful to discard a whole parallelogram-shaped section of the blade when the cutting edge becomes blunt. Also, it is time-consuming and troublesome to frequently replace the used-up blade with a new blade.

One solution to the problem would be to shorten the distance between frangible recesses. However, if the distance is too small, it is difficult to break a single section. Instead, two or more sections are broken at one time. In practice, the distance between two such frangible recesses on the blade of the prior art artistic technical knife is the shortest possible. However, such knives still waste a significant portion of the blade.

SUMMARY OF THE INVENTION

The present invention is designed to eliminate the foregoing defects of the prior art knives. The present invention relates to a double-edged knife, that is, a knife whose blade is sharpened along both edges, and has a sharpened point at the terminus of the blade. The blade further has a plurality of frangible recesses which extend at oblique angles from one edge of the blade to the opposite edge of the blade to divide the blade into a plurality of triangles. Preferably, each frangible recess is equal in length such that the blade is divided into a plurality of isosceles triangles. When the point at the terminus of the blade becomes blunt, only a triangular portion has to be broken. Then the vertex of the outermost triangle on the blade becomes the new sharpened point at the terminus of the blade. Therefore, each edge of the present double-edged blade is used to cut with. As a result, the present double-edged knife will last at least 50% longer than a prior art knife.

BRIEF DESCRIPTION OF THE DRAWINGS

The invention will be better understood, and objects other than those set forth above will become apparent, when consideration is given to the following detailed description thereof. This description makes reference to the attached drawings wherein.

DETAILED DESCRIPTION OF THE PREFERRED EMBODIMENT

Figure 1:
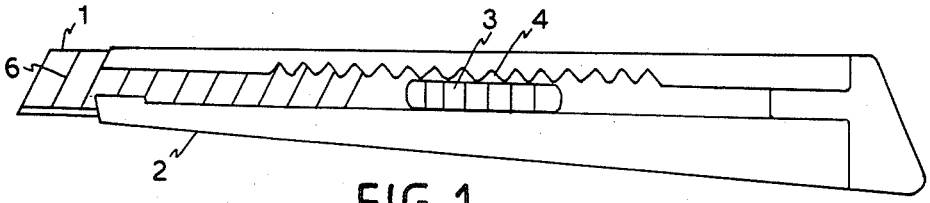
FIG. 1 is a front view of a prior art artistic technical knife.
Figure 2:
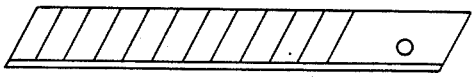
FIG. 2 is a front view of the blade of a prior art artistic technical knife.
Figure 3:
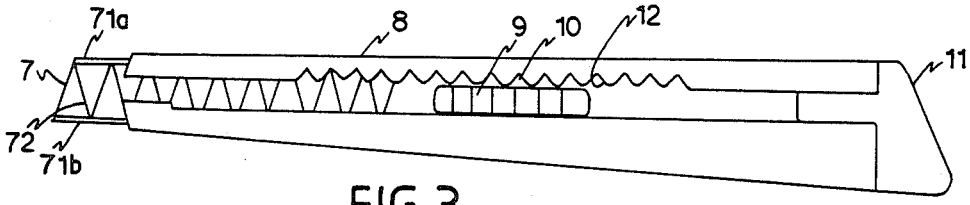
FIG. 3 is a front view of the knife of the present invention.
Figure 4:
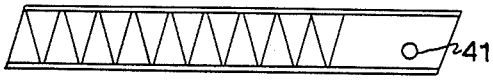
FIG. 4 is a front view of the blade of the present invention.

As shown in FIG. 3, a blade 7 is movably inserted in a holder 8. Blade 7 is extended and retracted from holder 8 by moving a push knob 9 to the left or right. An elastic control protrusion 10 controls movement of the push knob 9. Control protrusion 10 cooperates with recesses 12 in the handle to allow push knob 9 to move in fixed and discrete intervals to control the length of the blade protruding from the holder.

Blade 7 is sharpened on both of sides 71*a* and 71*b* and has a plurality of frangible recesses 72 which divide the blade into a plurality of triangles. When the sharpened point at the terminus of the blade becomes blunt, only one triangle has to be broken along the frangible recess 72. Then the original vertex of the cleaved triangle becomes the new sharpened point at the terminus of the blade. The triangle has an area that is one-half the area of the prior art parallelogram. Therefore, the present invention minimizes waste of the blade and the trouble of frequently replacing the blade.

To replace a used blade, the rear cover 11 is removed and the blade stub, the push knob 9 and a short fixing column which attaches push knob 9 to the blade is withdrawn. To attach a new blade 7 to push knob 9, the fixing hole 41 in blade 7 is fastened to the fixing column, which in turn, attaches to the push knob 9.

What we claim is:

1. An artistic technical knife comprising:

(a) a double-edged blade having a sharpened point at its terminus and a plurality of frangible recesses extending at oblique angles from one edge of the blade to the opposite edge of the blade to divide the blade into a plurality of triangles;

(b) a blade holder; and (c) a push knob for extending and retracting the blade from the blade holder;

wherein the outermost triangle on the blade can be severed and removed at the outermost frangible recess to provide a new sharpened point at the terminus of the blade.

2. A knife according to claim 1 wherein each frangible recess is equal in length such that the blade is divided into a plurality of isosceles triangles.

* * * * *